US006564518B1

(12) United States Patent
Weihrauch

(10) Patent No.: US 6,564,518 B1
(45) Date of Patent: May 20, 2003

(54) FLOOR WITH FLOOR COVERING, METHOD FOR LAYING SAID FLOOR CONVERING AND AUXILIARY LAYING DEVICE

(75) Inventor: Georg Weihrauch, Wald-Michelbach (DE)

(73) Assignee: Coronet-Werke GmbH, Wald-Michelbach (DE)

( * ) Notice: Subject to any disclaimer, the term of this patent is extended or adjusted under 35 U.S.C. 154(b) by 0 days.

(21) Appl. No.: 09/486,632

(22) PCT Filed: Aug. 20, 1998

(86) PCT No.: PCT/EP98/05301

§ 371 (c)(1),
(2), (4) Date: Nov. 27, 2000

(87) PCT Pub. No.: WO99/13182

PCT Pub. Date: Mar. 18, 1999

(30) Foreign Application Priority Data

Sep. 11, 1997 (DE) ..... 197 40 005

(51) Int. Cl.[7] ..... E04C 2/52

(52) U.S. Cl. ..... 52/220.1; 52/220.3; 52/461; 52/465; 52/468; 52/470; 52/471

(58) Field of Search ..... 52/220.1, 220.3, 52/220.5, 220.2, 632, 459, 460, 465, 461, 468, 470, 471, 506.01, 716.1, 287.1, 290

(56) References Cited

U.S. PATENT DOCUMENTS 3,724,148 A * 4/1973 Bregenzer ..... 52/220.5
4,124,324 A * 11/1978 Augis et al. ..... 404/3
4,319,438 A * 3/1982 Mikajiri ..... 52/221
4,562,635 A * 1/1986 Carter ..... 29/432
4,612,746 A * 9/1986 Higgins ..... 52/221
5,020,294 A * 6/1991 Duda ..... 52/396.07
5,542,780 A * 8/1996 Kourgli ..... 405/55
5,628,157 A * 5/1997 Chen ..... 52/263
5,736,676 A * 4/1998 Stelter et al. ..... 174/53
6,072,121 A * 6/2000 Penczak et al. ..... 174/48

FOREIGN PATENT DOCUMENTS

| | | |
|---|---|---|
| DE | 40 21 958 | 4/1992 |
| DE | 93 02 731 | 6/1993 |
| WO | WO 93 08 348 | 4/1993 |

* cited by examiner

*Primary Examiner*—Carl D. Friedman
*Assistant Examiner*—Jennifer I. Thissell
(74) *Attorney, Agent, or Firm*—Paul Vincent

(57) ABSTRACT

A flooring assembly consists essentially of a stable sub-flooring and a flooring applied thereon over a wide area with at least one floor element for insertion into a gap in the flooring at substantially the same level having different properties than the flooring. In order to avoid retroactive work on the sub-flooring, a placement aid is provided for in the form of a casing whose inner contour approximately corresponds to that of the floor element and whose outer contour to that of the gap and whose height corresponds approximately to the thickness of the flooring and which is mounted to the sub-flooring structure in a similar manner as the flooring. The casing has a lid which can be removed, after placement and flush fitting of the flooring to the casing, for insertion of the floor elements.

11 Claims, 1 Drawing Sheet

FLOOR WITH FLOOR COVERING, METHOD FOR LAYING SAID FLOOR CONVERING AND AUXILIARY LAYING DEVICE

BACKGROUND OF THE INVENTION

The invention concerns a floor assembly consisting essentially of a stable sub-flooring, a flooring placed over a wide area thereon and at least one floor element placed into a gap in the flooring and substantially level therewith having different properties than the flooring. The invention also concerns a method for placement of such flooring on a stable sub-flooring structure.

Conventional flooring such as textile flooring, tiles, plates, parquet and the like are installed after completion of the sub-flooring structure. The sub-flooring normally has a floor pavement forming the required flat surface for the flooring. A bonding agent for the flooring is then applied thereto and could be a mortar layer, a layer of glue or the like. For textile flooring in swaths or in tile form, the bonding agent may be eliminated if the flooring material is sufficiently heavy.

It is often necessary to introduce a different type of flooring element within a large area flooring. A simplest example thereof is a doormat disposed in the entrance region. In public and industrial buildings, large area pre-cleaning zones are often provided in the entrance regions. Certain larger areas and rooms, in particular departure and waiting areas in airports, but also in multiple use buildings, are subject to particular high wear conditions e.g. due to frequency of use and also to luggage carriers and the like. Flooring is often used in such regions which is different than that used in the remaining regions of the floor.

Such inserted flooring elements always require modification of the subflooring structure either during construction in association with the application of the floor pavement or retroactively in that e.g. linings or complete frames are introduced into the floor pavement. Towards this end, it is necessary for the floor pavement to be partially removed or sliced. Since various installations, e.g. electrical, water and heating, are often placed on top of the sub-flooring structure and covered with the floor pavement, retroactive processing of the floor pavement can always result in damage thereto. In many cases, neither pre-processing nor retroactive processing at the desired location can be effected due to these installed conduits and cables.

Since inserted floor elements require post-processing of the sub-flooring, in particular in the floor pavement, this work is carried out by other contractors than those installing the flooring itself. It is therefore necessary to employ different workers than those used for laying the flooring. This makes such a flooring expensive and requires associated coordination of the work, leading to losses in time and delays. This is particularly the case when such floor elements must be retroactively introduced into a completed flooring. Reference is made e.g. to prior art given in GB 2 241 166.

In order to avoid the retroactive working of sub-flooring, flooring elements are also utilized which can be placed over a large area flooring. As a result thereof tripping edges are formed or the floor elements must be given a properly tilted transitional region. Such locations are, however, always a danger for the user as well as an impediment for rolling vehicles and the like. Reference is made e.g. to prior art given in U.S. Pat. No. 4,654,245 and DE 31 24 529.

SUMMARY OF THE INVENTION

It is the underlying purpose of the invention, to propose a flooring surface and a method for placing same with which the above mentioned disadvantages of inserted and superimposed flooring elements are avoided and which facilitates an initial application as well as a retroactive application of the flooring elements in a simpler and more economic fashion.

The first part of this purpose is achieved in accordance with the invention by providing for a placement aid in the form of a casing whose inner contour corresponds approximately to that of the floor element and whose outer contour to that of the gap and whose height approximately corresponds to the thickness of the flooring and which is secured to the sub-flooring structure in the same manner as the flooring, wherein the floor element is inserted into the casing.

The central point of the invention is the utilization of a casing as a placement aid having the contours of the floor element which is to be inserted and which otherwise supports the flooring in the vicinity of the gap immediately adjacent thereto. The casing has the same height as the flooring and can be positioned by the person installing the flooring. Should the flooring comprise ceramic tiles, the walls of the casing can serve for the formation of joints to guarantee an even seam structure after placement of the floor elements. In this case, the casing has the dimensions of the tile. In the event of textile flooring or parquet, a flush adjacency is desired. In this case, the floor element can have a peripheral edge strip which seats on the upper edge of the casing. The floor elements can comprise tiles of different kinds, parquet having different structures or hardnesses, textile tiles, coarse matting materials, bristle mats and the like. Such casings can also have purely decorative uses for interrupting the large surface flooring with differently colored, differently structured, or purely decorative floor elements. The floor elements can also contain emblems, slogans or the like of decorative format. The floor elements can also be introduced retroactively into an existing flooring by fashioning an appropriate gap in the flooring, inserting the casing, processing, if necessary, the transitional region between the flooring and the casing, and inserting the floor element. The floor element can be mounted within the casing in any conventional manner. The floor element can also be easily exchanged without requiring reworking of the flooring itself.

For larger gaps in the flooring, a plurality of floor elements are normally provided. In this case, a plurality of casings can be positioned in a grid-like manner.

The casing normally has a rectangular, polygon or round shape. In order to insert larger floor elements, the side walls of the casing can be adapted to break-off. In this case, the casings have a grid-like structure. Also in this case, the flooring is placed flush with the outer walls of the casing and the inwardly disposed side walls are broken-off accordingly.

In order to solve the purpose of the invention with regard to a method, the invention provides that, prior to installation, a casing is positioned onto the sub-flooring at the location of the floor element whose inner contours approximately correspond to those of the floor element and whose outer contours approximately correspond to those of the gap and whose height approximately corresponds to the height of the flooring and, subsequent thereto, the flooring is installed over a large area and fitted flush with the casing and the floor element is inserted into the casing.

The casing is preferentially attached to the sub-flooring in the same manner as the flooring itself.

Finally, in the case of a plurality of mutually adjacent floor elements or in the event of larger floor elements, a plurality of casings can be positioned in a grid-like fashion onto the sub-flooring structure.

In addition, the invention proposes a placement aid in the form of a casing open at the top whose outer contour corresponds approximately to the gap provided for in the flooring for the floor element and whose inner contour corresponds approximately to those of the floor element and whose height approximately corresponds to the thickness of the flooring with the casing being mounted to the sub-flooring in a similar fashion as the flooring.

The casing preferentially has a lid having a handle. In this manner, the casing can be positioned on the sub-flooring structure and all flooring work can be carried out. Subsequent thereto, the lid can be removed in order to insert the floor element.

The bottom of the casing can have gaps to improve its anchoring in the bonding agent layer introduced onto the sub-flooring structure. The bonding agent can also penetrate through the gaps in an upward direction to thereby assist in the attachment of the floor element within the casing.

The invention is described below with reference to embodiments shown in the drawing.

DESCRIPTION OF THE PREFERRED EMBODIMENT

Figure 1:
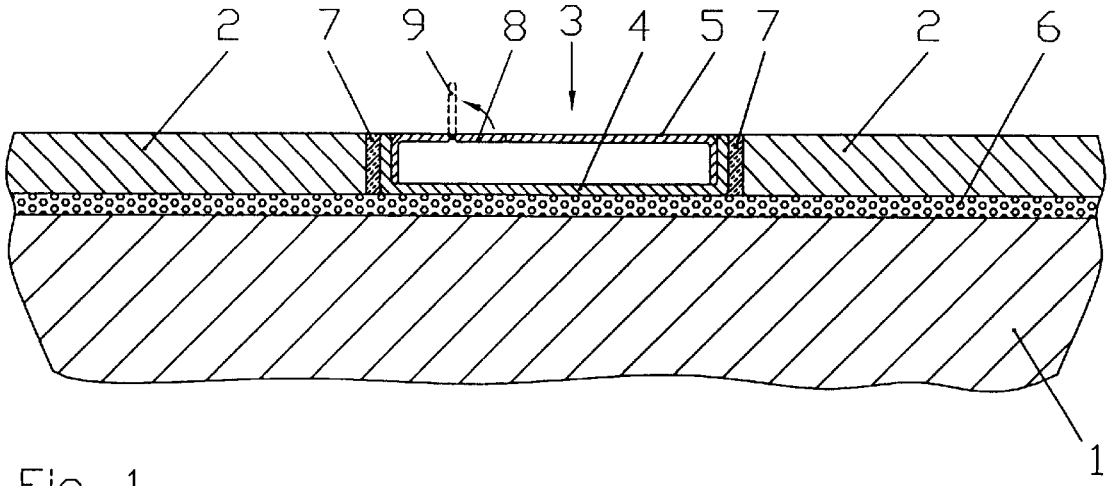
FIG. 1 shows a cross section through a floor structure with one embodiment of the placement aid.

In the drawing, the sub-flooring structure is designated with reference symbol 1. It can have a multi-layered structure e.g. having a floor pavement covering the installed pipes and cables seating on the support structure upon which the flooring 2 is installed over a large area. Floor elements having different properties and, if appropriate, made from different materials are to be inserted into the flooring 2. The flooring 2 has corresponding gaps 3 at these locations. A closed casing 4 is inserted into these gaps 3 having a lid 5 and serving as a placement aid. The casing 4 with the lid 5 has approximately the same height as the thickness of the flooring 2.

The flooring 2 is mounted on the sub-flooring with the assistance of a bonding layer 6, e.g. glue, binding mortar or the like. The casing 4 is attached to the sub-flooring 1 in the same manner.

When installing the flooring, one proceeds in such a fashion that the bonding layer 6 is initially introduced onto the sub-flooring 1 and, subsequent thereto, the flooring 2 is applied over a wide area. The casings 4 are positioned at the locations of the gaps 3 in the flooring 2 and mounted via the layer 6 to the substructure 1 in a similar fashion. Subsequent thereto, for example in the event of tiles, parquet or the like, the seams 7 between the flooring 2 made from tiles or parquet and the casing 4 can be sealed using a suitable material so that flush adjacency to the casing 4 is effected.

Figure 2:
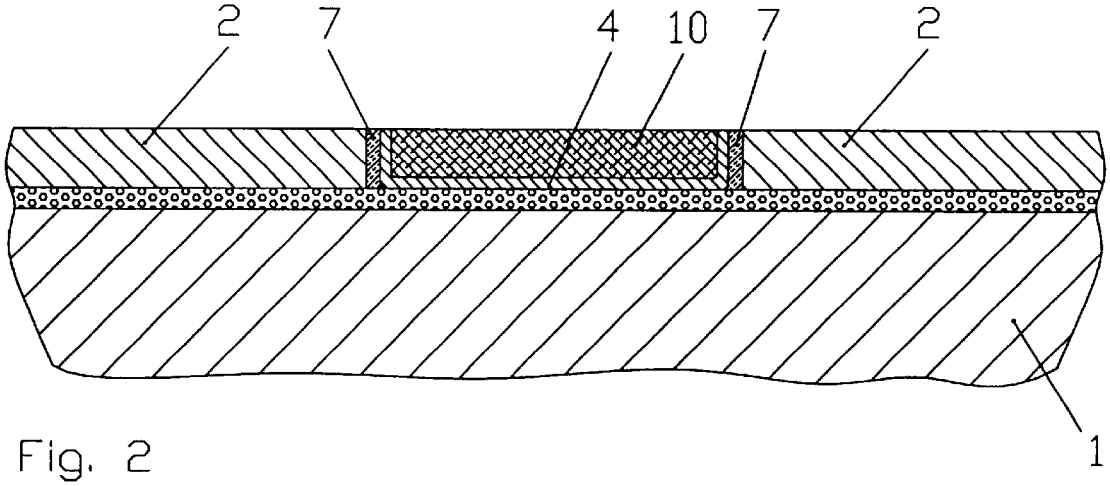
FIG. 2 shows a cross section in accordance with FIG. 1 during installation.

The lid 5 is subsequently removed. Towards this end, it has e.g. an integral handle 8 which can be raised to the position 9 for removing the lid. After the lid 5 has been removed, the floor element 10 is inserted into the open casing 4 to completely fill the interior region of the casing and seat flush with the upper side of the flooring 2 (FIG. 2). It is however also possible for the floor element 10 to protrude slightly above the flooring 2, e.g. having a rough layer in the form of matted fiber, bristles, nap or the like.

Figure 3:
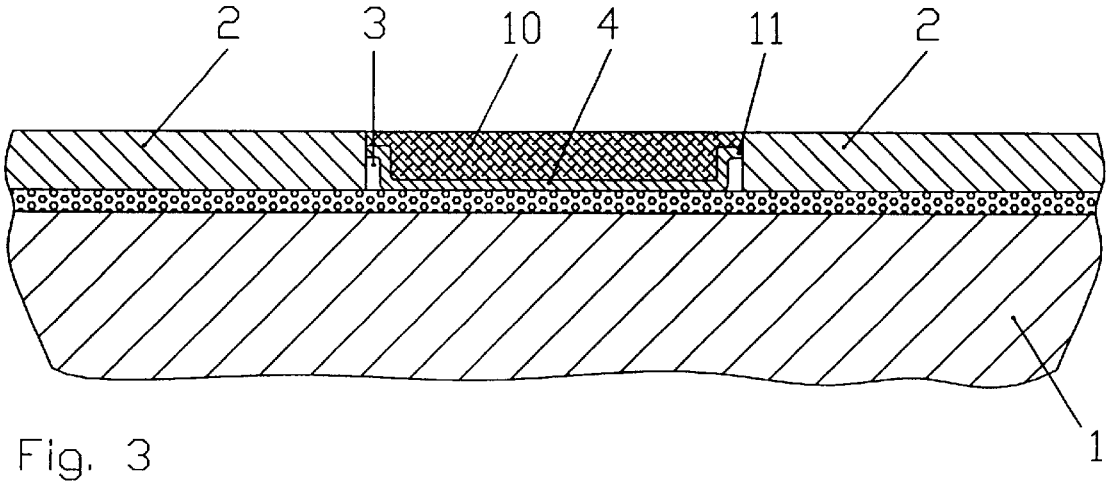
FIG. 3 shows a cross section corresponding to FIG. 1 with a different embodiment of the placement aid.

In the embodiment in accordance with FIG. 3, the casing 4 has a peripheral flange 11. This embodiment is particularly advantageous when the flooring 2 is a textile or hard rubber covering and when floor elements having different properties are to be inserted into the casing 4. In this case, the floor element is cut flush with the opening 3 in the flooring 2 and its lower side is undercut so that it seats with its peripheral edge on the flange 11 of the casing.

It can be clearly seen from the above description that the casings 4 can also be disposed in a grid-like manner or in any kind of decorative manner at separations with respect to each other in order to produce larger or interrupted zones having different structures, loading strengths with respect to walking or rolling, differing decorative effects, and the like.

I claim:

1. A floor system for covering a stable sub-flooring, the floor system comprising:

a flooring disposed on the sub-flooring for covering a large area thereof, said flooring having an opening exposing the sub-flooring, said flooring also having a first upper surface, said first upper surface having a first surface property, and said opening having inner opening contours;

a casing for insertion into said opening to seat on the sub-flooring, said casing having outer casing contours which are proximate to said inner opening contours following insertion of said casing into said opening, said casing having inner contours and a casing height;

a prefabricated floor element or group of floor elements of stable, substantially unchanging shape, said floor element or group of floor elements for insertion into said casing to substantially fill said casing, said floor element having a second upper surface having a second surface property different than said first surface property, said floor element or group of floor elements having outer element contours which are proximate to said inner casing contours following insertion of said floor element or group of floor elements into said casing; and means for securing said casing and said flooring to the sub-flooring, wherein said securing means, said casing, and said floor element cooperate to dispose said second upper surface in alignment with said first upper surface.

2. The floor element of claim 1, further comprising a plurality of casings disposed in a grid-like manner in an opening in said flooring.

3. A method for installing a floor system for covering a stable sub-flooring, the method comprising the steps of:

a) disposing flooring on the sub-flooring for covering a large area thereof, said flooring having an opening exposing the sub-flooring, said flooring also having a first upper surface, said first upper surface having a first surface property and said opening having inner opening contours;

b) inserting a casing into said opening to seat on the sub-flooring, said casing having outer casing contours which are proximate to said inner opening contours following casing insertion, said casing having inner casing contours and a casing height; and c) inserting a prefabricated floor element or group of floor elements of stable, substantially unchanging shape into said casing to substantially fill said casing, said floor element having a second upper surface having a second surface property different than said first surface property, said floor element or group of floor elements having outer element contours which are proximate to said inner casing contours following floor element insertion, wherein said second upper surface is aligned with said first upper surface.

4. The method of claim 3, further comprising mounting said casing to the sub-flooring in a same fashion as said flooring.

5. The method of claim 4, further comprising, in step b), positioning a plurality of casings in a grid-like manner into said opening and, in step c), inserting at least one of a plurality of mutually adjacent floor elements and floor elements larger than said mutually adjacent floor elements into said plurality of casings.

6. The casing for use in the method of claim 3, wherein the casing comprises side walls defining outer casing contours, inner casing contours, and a casing height.

7. The casing of claim 6, further comprising a lid for closing an upper opening in said casing and a handle cooperating with said lid to withdraw said lid from said casing, said lid cooperating with said walls in a manually removable manner.

8. The casing of claim 7, wherein said handle is coplanar with said lid, and further comprising means for attaching said handle to said lid to raise said handle relative to said lid.

9. The casing of claim 6, wherein said casing further comprises a bottom having holes.

10. The casing of claim 6, wherein said casing height is smaller than a height of the flooring, wherein said casing further comprises an edge for a border strip of the floor element.

11. The casing of claim 6, wherein said side walls can be broken off.

* * * * *